US005647775A

United States Patent [19]

Polgar et al.

[11] Patent Number: 5,647,775

[45] Date of Patent: Jul. 15, 1997

[54] ELECTRICAL CONNECTOR WITH TERMINAL LOCKING MEANS

[75] Inventors: Gary E. Polgar, Bolingbrook; Randy Joe Kempf, Naperville; Rupert J. Fry, Des Plaines, all of Ill.

[73] Assignee: Molex Incorporated, Lisle, Ill.

[21] Appl. No.: 568,917

[22] Filed: Dec. 7, 1995

[51] Int. Cl.[6] ..... H01R 13/514

[52] U.S. Cl. ..... 439/752

[58] Field of Search ..... 439/752, 596, 439/597

[56] References Cited

U.S. PATENT DOCUMENTS

| | | | |
|---|---|---|---|
| 3,693,134 | 9/1972 | Trevisiol | 339/59 |
| 4,017,141 | 4/1977 | Bury et al. | 339/217 |
| 4,354,719 | 10/1982 | Weidler . | |
| 4,679,874 | 7/1987 | Saijo et al. | 439/595 |
| 4,705,337 | 11/1987 | Maeda | 439/595 |
| 4,711,508 | 12/1987 | Sueyoshi | 439/595 |
| 4,750,893 | 6/1988 | Sueyoshi et al. | 439/596 |
| 4,753,612 | 6/1988 | Betsui | 439/596 |
| 4,767,361 | 8/1988 | Hoshino et al. | 439/596 |
| 4,772,229 | 9/1988 | Nix et al. | 439/733 |
| 4,876,705 | 10/1989 | Yuasa | 439/595 |
| 4,979,913 | 12/1990 | Aiello et al. | 439/596 |
| 5,076,806 | 12/1991 | Hotea et al. | 439/595 |
| 5,120,269 | 6/1992 | Endo et al. | 439/752 |
| 5,160,283 | 11/1992 | Fry et al. | 439/752 |
| 5,292,262 | 3/1994 | Endo et al. | 439/752 |
| 5,316,504 | 5/1994 | Jinno | 439/752 |

*Primary Examiner*—Gary F. Paumen
*Assistant Examiner*—Christopher Goins
*Attorney, Agent, or Firm*—Stephen Z. Weiss

[57] ABSTRACT

An electrical connector includes a dielectric housing having an elongated terminal-receiving cavity. A window is provided in an outer wall of the housing communicating with the cavity. A terminal is insertable into the cavity to a final position and has a transverse wall alignable with the window when the terminal is in its final position. A terminal locking member has a bifurcated portion adapted for insertion through the window in the housing for embracing opposite sides of the transverse wall of the terminal.

16 Claims, 5 Drawing Sheets

ELECTRICAL CONNECTOR WITH TERMINAL LOCKING MEANS

FIELD OF THE INVENTION

This invention generally relates to the art of electrical connectors and, particularly, to an electrical connector which incorporates a locking member for locking a terminal in a connector housing.

BACKGROUND OF THE INVENTION

Typical electrical connectors include housings normally of insulating material and having a plurality of cavities or passages into which male or female terminals are inserted. In a hard wired connector, each terminal normally is pre-crimped to a wire conductor and then inserted into a housing cavity where it is retained in place by a locking structure. Typically the locking structure may include resilient tangs or latch projections which engage shoulders on the housing within the cavity. Mating plug and socket housings then can be joined in order to interconnect mating male and female terminals mounted in the housings, or the housings might be joined with other terminal supporting devices.

Although connectors of the character described above have been successfully used for many years, unreliable interconnections between the terminals can occur in some instances. For example, a terminal may not be fully inserted into its housing cavity during assembly whereby the locking structure is not effective to secure the terminal in place. When the terminal is joined with a mating terminal, the incompletely mounted terminal can be pushed out of position so that the interconnection between terminals is not made. In addition, even if a connection is made initially, a terminal can subsequently work loose because of vibrations or other extraneous forces and cause a faulty or intermittent connection. Consequently, a variety of systems have been designed wherein a separate terminal locking member is employed on the connector housing to act as either a primary or a secondary locking means. These locking members are inserted longitudinally or laterally into the connector housing. Those locking members inserted longitudinally, although working satisfactorily for certain applications, require two separate parts to be molded, inventoried and shipped which adds to the cost and labor of the connector.

In order to avoid the expensive separate locking members, systems have been designed wherein the locking members have been molded integrally with the housing and inserted laterally into the terminal cavities. These laterally inserted locking members have projections which directly contact an edge or shoulder of a terminal. Because the edge of the terminal and the contact portion of the projection must be located with accuracy, very close tolerances on the dimensions of these parts must be maintained during manufacture. This increases the cost of manufacturing. There is a need for a system which employs laterally inserted locking members which is simple and efficient to manufacture and use and avoiding the requirement for maintaining close tolerances during manufacture, thereby reducing manufacturing costs. The present invention is directed to satisfying that need and solving the variety of problems outlined above.

SUMMARY OF THE INVENTION

An object, therefore, of the invention is to provide a new and improved electrical connector of the character described, incorporating a novel terminal locking system.

In the exemplary embodiment of the invention, the electrical connector includes a dielectric housing having a forward mating end, a rearward terminating end, an elongated terminal-receiving cavity extending in an axial direction between the ends, and a window in an outer side wall of the housing communicating with the cavity. An elongated terminal is insertable in the axial direction into a final position. The terminal includes a forward contact end, a rearward conductor-engaging end and an intermediate body portion between the ends. The body portion has a wall transverse to the axial direction and alignable with the window when the terminal is in its final position. A terminal locking member has a two-pronged locking projection adapted to pass through the window into the cavity with the prongs engaging opposite sides of the transverse wall of the terminal. This prevents axial movement of the terminal relative to the cavity.

As disclosed herein, the terminal is stamped and formed of sheet metal material. The terminal includes spaced side walls with the transverse wall being formed from portions of each side wall bent inwardly toward each other. The housing is molded of plastic dielectric material with an integral living hinge portion connecting the terminal locking member integrally with the housing.

Still further, at least one prong of the two-pronged locking projection includes a camming surface for engaging the transverse wall of the terminal and moving the terminal from at least one position of incomplete insertion to the final position of the terminal. Preferably, each prong of the two-pronged locking projection includes a camming surface for engaging the transverse wall of the terminal to guide the wall between the prongs.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
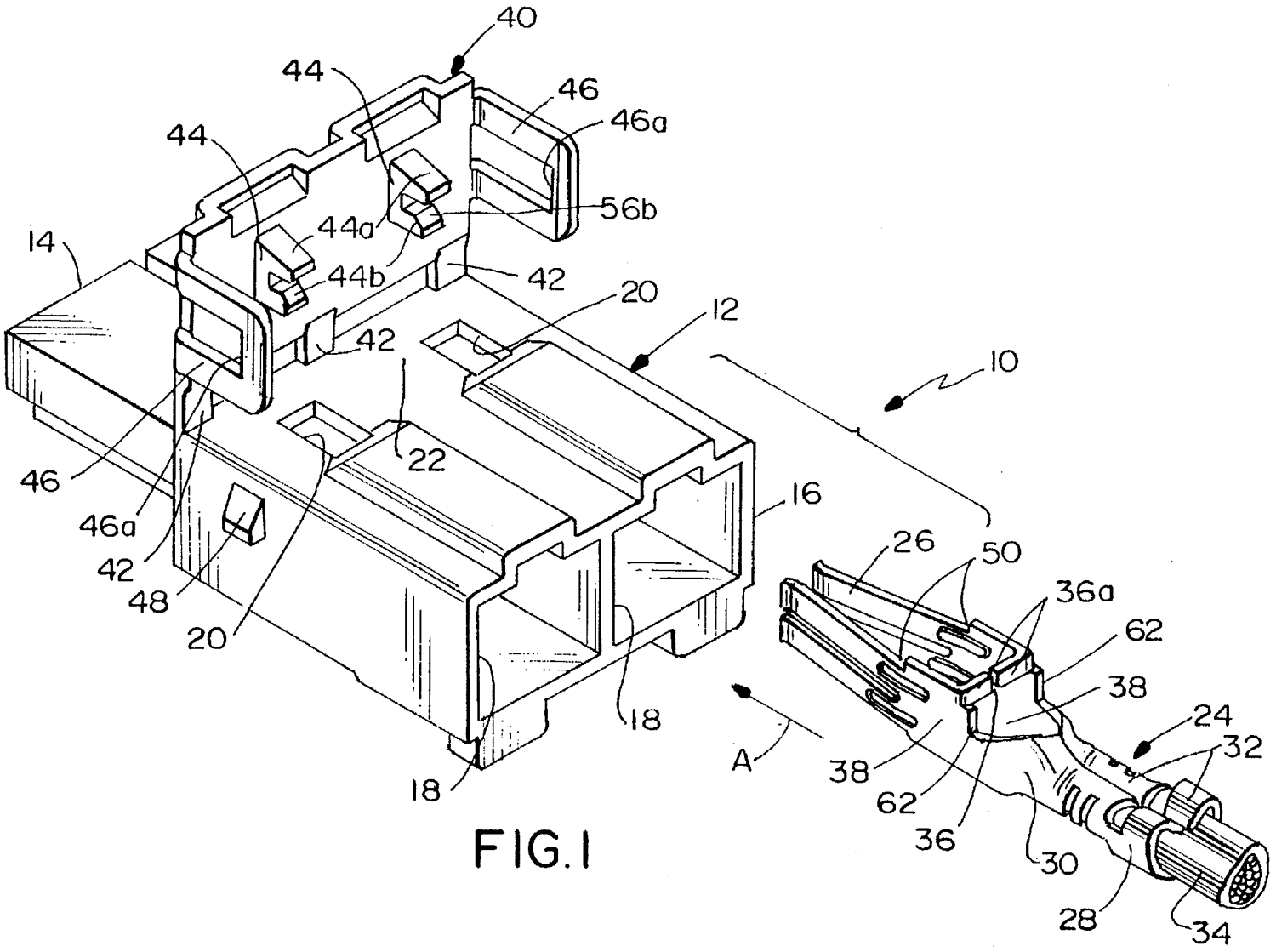
FIG. 1 is a perspective view of a first embodiment of an electrical connector incorporating the concepts of the invention.

Referring to the drawings in greater detail, and first to FIG. 1, the invention is embodied in an electrical connector, generally designated 10, which includes a dielectric housing, generally designated 12. The housing is unitarily molded of dielectric material such as plastic or the like. The housing has a forward mating end 14 and a rearward terminating end 16. A plurality of elongated terminal-receiving cavities 18 extend in an axial direction between the ends. A window 20 in an outer wall 22 of the housing communicates with each cavity 18.

An elongated terminal, generally designated 24, is insertable into each cavity 18 in housing 12 in an axial direction as indicated by arrow "A" (FIG. 1). Only one terminal is shown in FIG. 1, but each terminal includes a forward contact end 26, a rearward conductor-engaging end 28 and an intermediate body portion 30 between the ends. The conductor-engaging end has two pairs of crimp arms 32 for crimping onto a conductor 34, such as an insulated stranded wire. Body portion 30 has a wall, generally designated 36, transverse to axial direction "A" and alignable with the window 20 of the respective cavity 18 when the terminal is in its final inserted position described hereinafter. The terminal is stamped and formed of sheet metal material, and body portion 30 includes a pair of transversely spaced side walls 38. Transverse wall 36 is formed from portions **36*a* of each side wall 38** bent inwardly toward each other.

Figure 3:
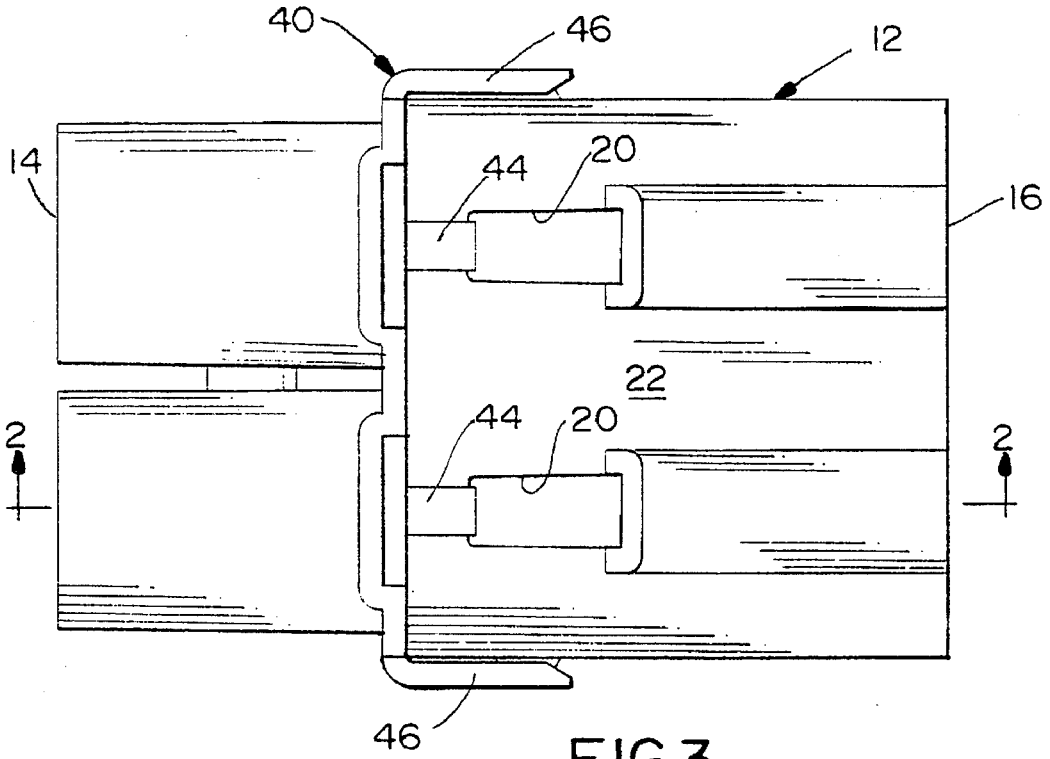
FIG. 3 is a top plan view of the housing in the open position of the terminal locking member as shown in FIG. 1.
Figure 2:
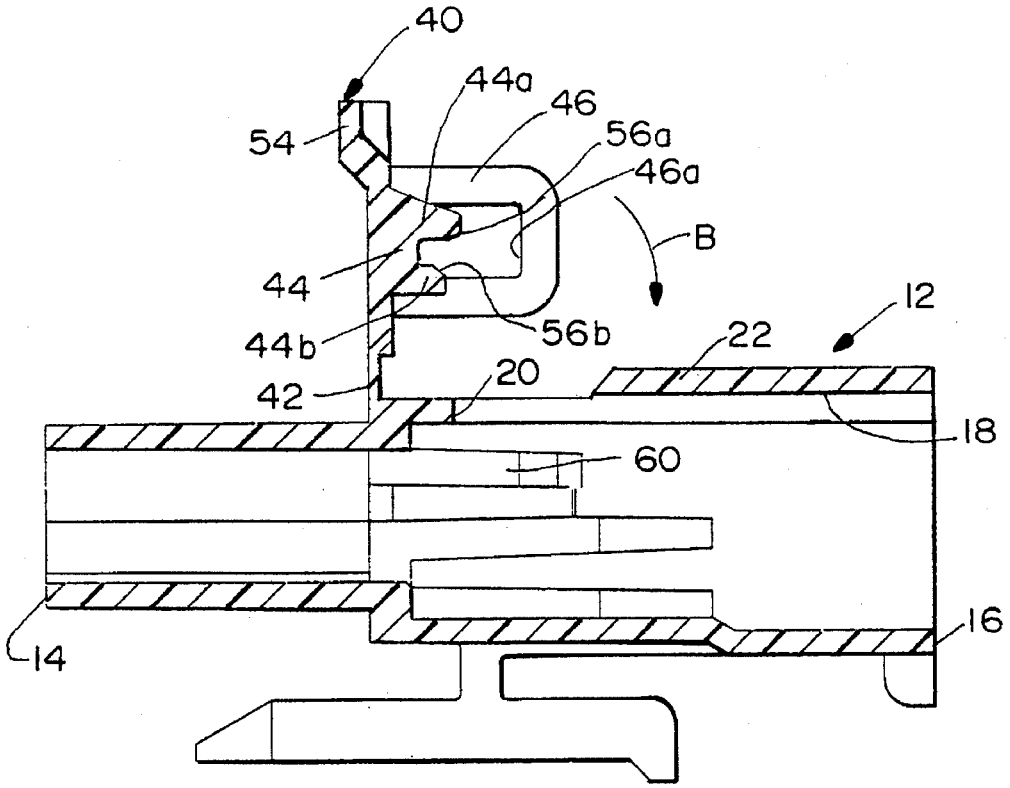
FIG. 2 is a vertical section taken generally along line 2—2 of FIG. 3.
Figure 4:
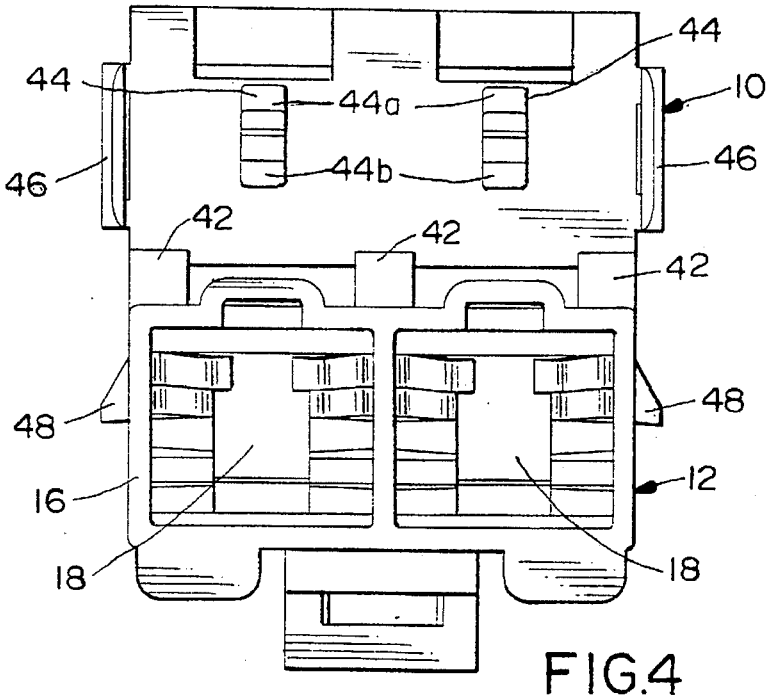
FIG. 4 is a rear elevational view similar looking toward the right-hand end of FIG. 3.

Referring to FIGS. 2–4 in conjunction with FIG. 1, a terminal locking member, generally designated 40, is hinged to housing 12 by an integral living hinge portion 42 as best seen in FIG. 2, whereby the locking member is molded integrally with the housing. Therefore, the locking member is pivotable about living hinge 42 in the direction of arrow "B" from an open or inoperative position shown in FIGS. 2–4 to a closed locking position described hereinafter.

Terminal locking member 40 has a two-pronged locking projection 44 adapted to pass through each window 20 in outer side wall 22 of the housing and into the respective cavity 18. Each projection includes two prongs **44*a* and 44*b* adapted to embrace transverse wall 36 of the respective terminal 24, as will be seen hereinafter. Lastly, the terminal locking member includes a pair of U-shaped latch arms 46 at opposite sides of the locking member to define a pair of latch shoulders 46a which latchingly engage a pair of chamfered latch bosses 48 on opposite sides of housing 12**.

Figure 5:
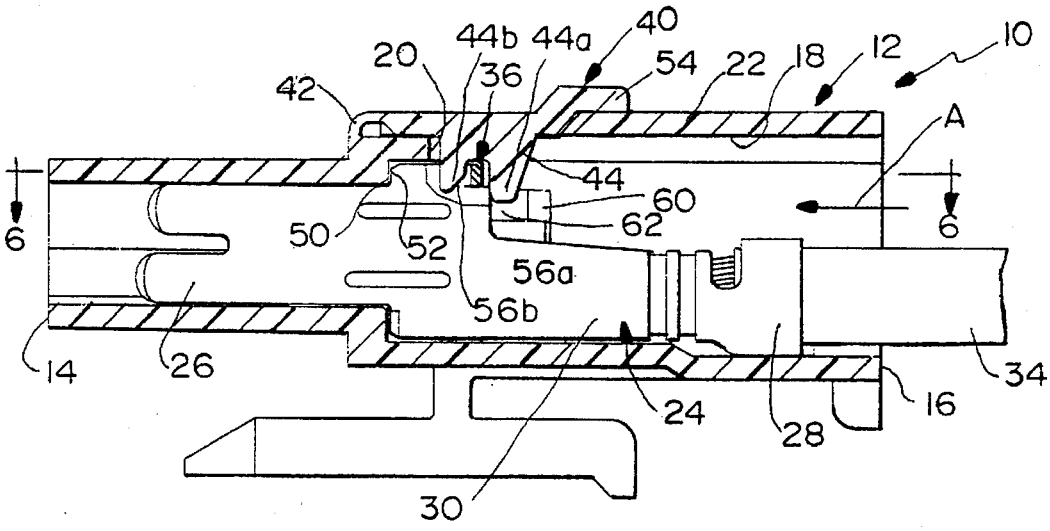
FIG. 5 is a view similar to that of FIG. 2, but with a terminal in its final position and the terminal locking member in its closed position.
Figure 6:
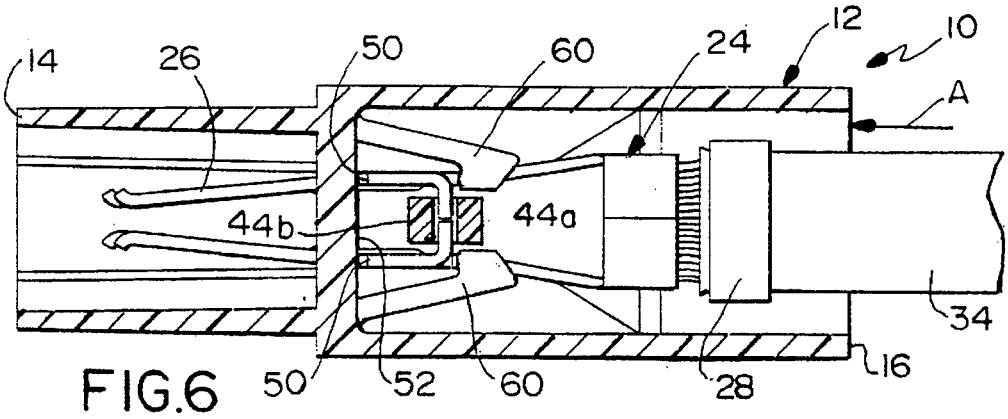
FIG. 6 is a fragmented horizontal section taken generally along line 6—6 of FIG. 5.

Referring to FIGS. 5 and 6, connector 10 is assembled by inserting one of the terminals 24 into each terminal-receiving cavity 18 in housing 12 in the axial direction "A". In its final or fully inserted position as shown, a pair of forwardly facing abutment shoulders 50 on side walls 38 of the terminal abuts an interior shoulder 52 within the respective cavity of the housing. When the terminal(s) is fully inserted, terminal locking member 40 (FIG. 5) is pivoted about living hinge 42 to its closed locking position shown in FIG. 5. When in the closed locking position, prongs **44*a* and 44*b* of two-pronged locking projection 44 engage on opposite sides of transverse wall 36 as clearly seen in FIGS. 5 and 6. When the terminal locking member is fully closed, a lip 54 thereof engages the top of outer wall 22 of housing 12 rearwardly of windows 20. The locking member is held in its closed locking position by latch arms 46 engaging latch bosses 48** on the housing.

In order to facilitate closing the terminal locking member and/or finally positioning terminals 24, prong **44*a* of two-pronged projection 44 includes an inwardly facing camming surface 56*a*, and prong 44b includes an inwardly facing camming surface 56*b*. The camming surfaces are effective to engage transverse wall 36 of the terminal to guide the wall between prongs 44*a* and 44*b*. In addition, in the event that one of the terminals is not quite in its fully inserted or final position, camming surface 56*a* on prong 44*a* is effective to drive the terminal forwardly to abut shoulders 50 and 52 in response to closing the terminal locking member. It can be seen that camming surface 56*b* on prong 44*b* is more drastic than camming surface 56*a* on prong 44*a*. This is to provide increased clearance between prong 44*b* and transverse wall 36 of the terminal as locking member 40 pivots about living hinge 42**.

Lastly, it should be understood that terminal locking member 40 can act as either a primary or a secondary locking means. In the embodiment of connector 10, the terminal locking member is used as a secondary locking means. More particularly, referring to FIGS. 5 and 6, housing 12 has a pair of flexible cantilevered locking arms 60 (see FIG. 6) which are effective to lock behind a pair of rearwardly facing shoulders 62 (FIGS. 1 and 5) formed from side walls 38 of body portion 30 of the terminal. In this system, terminal locking member 40 would be used as a secondary locking means.

FIGS. 7–10 show two alternate embodiments of the invention wherein like numerals have been applied to designate like elements or components described above in relation to FIGS. 1–6. The difference in the embodiments of FIGS. 7–10 versus the embodiment of FIGS. 1–6 resides in the means for integrally connecting terminal locking member 40 to connector housing 12. As stated above, in the first embodiment of FIGS. 1–6, the terminal locking member is integrally molded with the housing by means of a living hinge portion 42 as best seen in FIGS. 2 and 5.

Figure 7:
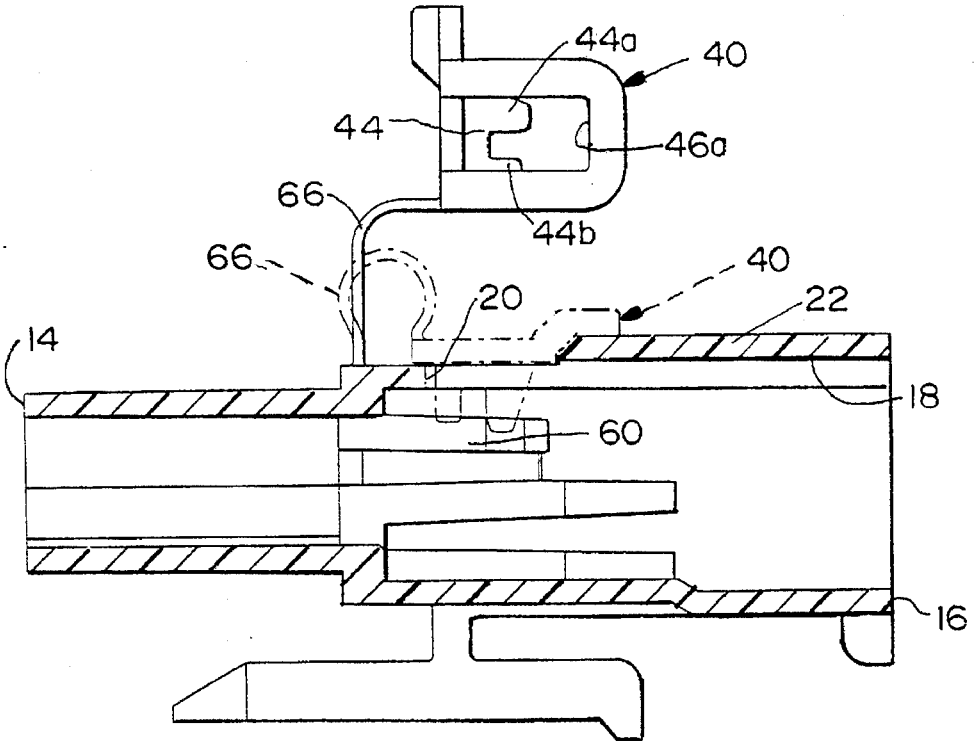
FIG. 7 is a view similar to that of FIG. 2, but of a second embodiment of the invention.
Figure 8:
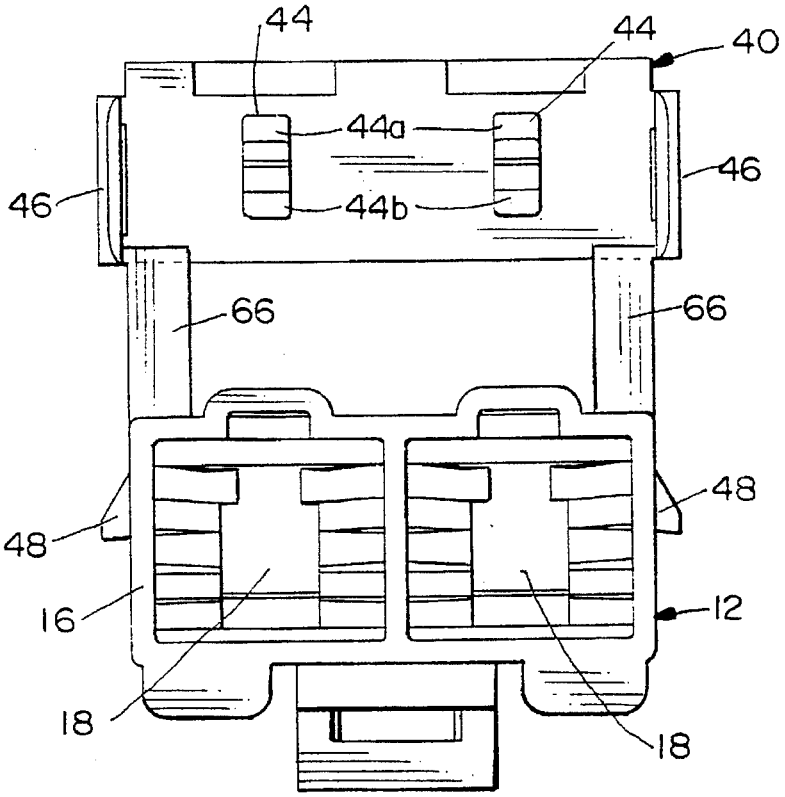
FIG. 8 is a view similar to that of FIG. 4, but of the embodiment shown in FIG. 7.
Figure 9:
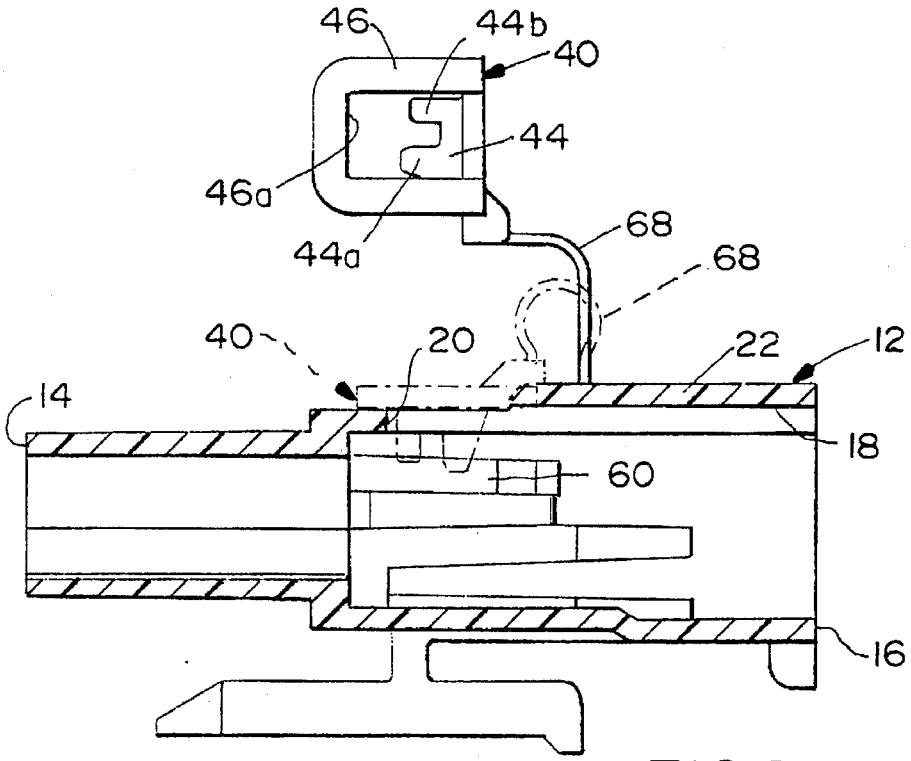
FIG. 9 is a view similar to that of FIGS. 2 and 7, but of a third embodiment of the invention.
Figure 10:
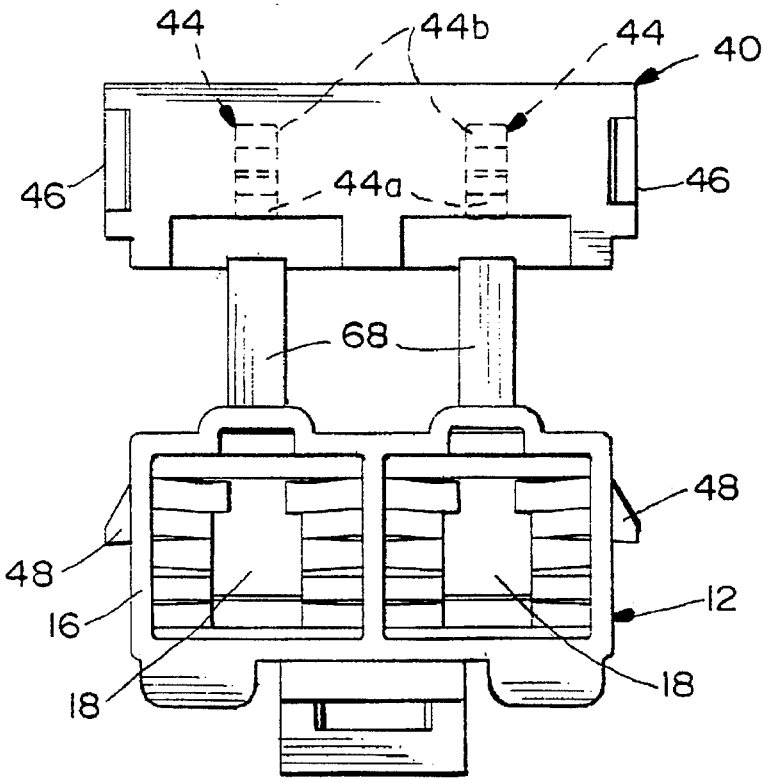
FIG. 10 is a view similar to that of FIG. 8, but of the third embodiment of the invention corresponding to the FIG. 9.

In the embodiments of FIGS. 7–10, terminal locking member 40 is integrally molded with connector housing 12 by means of elongated tether straps 66 in FIGS. 7 and 8 and tether straps 68 in FIGS. 9 and 10. Like living hinge 42, tether straps 66 and 68 allow the terminal locking member to be moved from an open inoperative position shown in full lines in FIGS. 7–10 to a closed locking position shown in phantom in FIGS. 7 and 9. Otherwise, the terminal locking member functions the same as described above in relation to the embodiment of connector 10 in FIGS. 1–6.

The advantages or providing relatively long tether straps 66 and 68 is that the molding process is less costly. The tether straps require less precision in the mold which reduces cost. In addition, the relatively long tether straps make it easier to position the terminal locking member in its closed locking position on the housing because of the increased relative movement between the locking member and the housing afforded by the long tether straps.

Lastly, it can be seen that the terminal locking member in FIGS. 7 and 8 is interconnected with housing 12 by the tether straps 66 which are located forwardly of windows 20. On the other hand, tether straps 68 in the embodiment of FIGS. 9 and 10, interconnect the terminal locking member to the housing at a point rearwardly of the windows, i.e. closer to rearward terminating end 16 of the housing. The advantages of the location of tether straps 68 simply concerns the tooling process in that the length of the tooling inserts or blades which would extend inwardly from the rear of the connector is reduced. Long tooling inserts have a tendency to become broken.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a dielectric housing having a forward mating end, a rearward terminating end, an elongated terminal-receiving cavity extending in an axial direction between the ends, and a window in an outer side wall of the housing communicating with the cavity;

an elongate terminal insertable in said axial direction into a final position and including a forward contact end, a rearward conductor-engaging end and an intermediate body portion between the ends, the body portion having a wall transverse to said axial direction and alignable with said window when the terminal is in said final position; and a terminal locking member having a two-pronged locking projection adapted to pass through said window into the cavity with the prongs engaging opposite sides of the transverse wall of the terminal thereby preventing axial movement of the terminal relative to the cavity.

2. The electrical connector of claim 1 wherein said body portion of the terminal includes spaced side walls with said transverse wall being formed from portions of each side wall bent inwardly toward each other.

3. The electrical connector of claim 2 wherein said terminal is stamped and formed of sheet metal material.

4. The electrical connector of claim 1 wherein said terminal locking member is formed integrally with the housing.

5. The electrical connector of claim 4 wherein said housing is molded of plastic dielectric material with an integral living hinge portion connecting the terminal locking member thereto.

6. The electrical connector of claim 1 wherein each prong of the two-pronged locking projection includes a camming surface for engaging the transverse wall of the terminal to guide the wall between the prongs.

7. The electrical connector of claim 1 wherein at least one prong of the two-pronged locking projection includes a camming surface for engaging the transverse wall of the terminal and moving the terminal from at least one position of incomplete insertion to said final position.

8. The electrical connector of claim 1 wherein said housing is molded of plastic dielectric material, and the terminal locking member is connected to the housing by integral tether straps which afford considerable relative movement between the terminal locking member and the dielectric housing.

9. An electrical connector, comprising:

a dielectric housing having an elongated terminal-receiving cavity extending in an axial direction and a window in an outer wall of the housing communicating with the cavity;

a terminal insertable into the cavity to a final position and having a wall transverse to the axial direction alignable with the window when the terminal is in its final position; and a terminal locking member having a bifurcated portion adapted for insertion through the window for embracing opposite sides of the transverse wall of the terminal.

10. The electrical connector of claim 9 wherein said terminal includes a body portion having spaced side walls with said transverse wall being formed from portions of each side wall bent inwardly toward each other.

11. The electrical connector of claim 10 wherein said terminal is stamped and formed of sheet metal material.

12. The electrical connector of claim 9 wherein said terminal locking member is formed integrally with the housing.

13. The electrical connector of claim 12 wherein said housing is molded of plastic dielectric material with an integral living hinge portion connecting the terminal locking member thereto.

14. The electrical connector of claim 9 wherein said bifurcated portion of the terminal locking member includes two prongs for engaging opposite sides of the transverse wall of the terminal, each prong including a camming surface for engaging the transverse wall of the terminal to guide the wall between the prongs.

15. The electrical connector of claim 9 wherein said bifurcated portion of the terminal locking member includes a camming surface for engaging the transverse wall of the terminal and moving the terminal from at least one position of incomplete insertion to said final position.

16. The electrical connector of claim 9 wherein said terminal locking member is connected to the housing by an integral tether strap of sufficient length to provide considerable relative movement between the terminal locking member and the housing on movement of the terminal locking member to its final position.

* * * * *